US007182825B2

(12) United States Patent
Ünal et al.

(10) Patent No.: US 7,182,825 B2
(45) Date of Patent: Feb. 27, 2007

(54) IN-LINE METHOD OF MAKING HEAT-TREATED AND ANNEALED ALUMINUM ALLOY SHEET

(75) Inventors: Ali Ünal, Export, PA (US); Gavin Federick Wyatt-Mair, Lafayette, CA (US); David Allen Tomes, Jr., Sparks, NV (US); David Wayne Timmons, Reno, NV (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/782,027

(22) Filed: Feb. 19, 2004

(65) Prior Publication Data

US 2005/0183801 A1 Aug. 25, 2005

(51) Int. Cl.
*C22F 1/04* (2006.01)

(52) U.S. Cl. ..... 148/551; 148/691; 148/694

(58) Field of Classification Search ..... 148/551, 148/552, 691–694
See application file for complete search history.

(56) References Cited

U.S. PATENT DOCUMENTS

| | | | | |
|---|---|---|---|---|
| 4,782,994 | A | 11/1988 | Raybould et al. | |
| 5,106,429 | A * | 4/1992 | McAuliffe et al. | 148/552 |
| 5,356,495 | A | 10/1994 | Wyatt-Mair et al. | |
| 5,470,405 | A | 11/1995 | Wyatt-Mair et al. | |
| 5,496,423 | A | 3/1996 | Wyatt-Mair et al. | |
| 5,514,228 | A * | 5/1996 | Wyatt-Mair et al. | 148/551 |
| 5,655,593 | A | 8/1997 | Wyatt-Mair et al. | |
| 5,728,241 | A | 3/1998 | Gupta et al. | |
| 5,769,972 | A * | 6/1998 | Sun et al. | 148/439 |
| 5,772,802 | A | 6/1998 | Sun et al. | |
| 5,833,775 | A * | 11/1998 | Newton et al. | 148/551 |
| 5,894,879 | A | 4/1999 | Wyatt-Mair et al. | |
| RE36,692 | E | 5/2000 | Gupta et al. | |
| 6,146,477 | A | 11/2000 | Clark et al. | |
| 6,264,765 | B1 * | 7/2001 | Bryant et al. | 148/511 |
| 6,264,769 | B1 | 7/2001 | Benedetti | |
| 6,280,543 | B1 * | 8/2001 | Zonker et al. | 148/551 |
| 6,336,980 | B1 | 1/2002 | Benedetti | |
| 6,391,127 | B1 | 5/2002 | Wyatt-Mair et al. | |
| 6,423,164 | B1 | 7/2002 | Bryant et al. | |
| 6,959,476 | B2 * | 11/2005 | Li et al. | 29/421.1 |
| 2004/0007295 | A1 * | 1/2004 | Lorentzen et al. | 148/552 |

OTHER PUBLICATIONS

"ASM Handbook: vol. 4 Heat treating", ASM International, 1991, pp. 851-857.*
"ASM Handbook: vol. 4 Heat Treating", ASM International, 1991, pp. 840,878-879.*

* cited by examiner

*Primary Examiner*—Roy King
*Assistant Examiner*—Janelle Morillo
(74) *Attorney, Agent, or Firm*—Greenberg Traurig; Harry A. Hild, Jr.

(57) ABSTRACT

A method of making aluminum alloy sheet in a continuous in-line process is provided. A continuously-cast aluminum alloy strip is optionally quenched, hot or warm rolled, annealed or heat-treated in-line, optionally quenched, and preferably coiled, with additional hot, warm or cold rolling steps as needed to reach the desired gauge. The process can be used to make aluminum alloy sheet of T or O temper having the desired properties, in a much shorter processing time.

45 Claims, 11 Drawing Sheets

IN-LINE METHOD OF MAKING HEAT-TREATED AND ANNEALED ALUMINUM ALLOY SHEET

FIELD OF THE INVENTION

The present invention relates to a method of making aluminum alloy sheet in a continuous in-line process. More specifically, a continuous process is used to make aluminum alloy sheet of T or O temper having the desired properties, with the minimum number of steps and shortest possible processing time.

BACKGROUND INFORMATION

Conventional methods of manufacturing of aluminum alloy sheet for use in commercial applications such as auto panels, reinforcements, beverage containers and aerospace applications employ batch processes which include an extensive sequence of separate steps. Typically, a large ingot is cast to a thickness of up to about 30 inches and cooled to ambient temperature, and then stored for later use. When an ingot is needed for further processing, it is first "scalped" to remove surface defects. Once the surface defects have been removed, the ingot is preheated to a temperature of about 104° F. for a period of 20 to 30 hours, to ensure that the components of the alloy are properly distributed throughout the metallurgical structure. It is then cooled to a lower temperature for hot rolling. Several passes are applied to reduce the thickness of the ingot to the required range for cold rolling. An intermediate anneal or a self-anneal is typically carried out on the coil. The resulting "hot band" is then cold-rolled to the desired gauge and coiled. For non-heat-treated products, the coil is further annealed in a batch step to obtain O-temper. To produce heat-treated products, the coiled sheet is subjected to a separate heat treatment operation, typically in a continuous heat-treat line. This involves unwinding the coil, solution heat treatment at a high temperature, quenching and recoiling. The above process, from start to finish, can take several weeks for preparing the coil for sale, resulting in large inventories of work in progress and final product, in addition to scrap losses at each stage of the process.

Because of the lengthy processing time in this flow path, numerous attempts have been made to shorten it by elimination of certain steps, while maintaining the desired properties in the finished product.

For example, U.S. Pat. No. 5,655,593 describes a method of making aluminum alloy sheet where a thin strip is cast (in place of a thick ingot) which is rapidly rolled and continuously cooled for a period of less than 30 seconds to a temperature of less than 350° F. U.S. Pat. No. 5,772,802 describes a method in which the aluminum alloy cast strip is quenched, rolled, annealed at temperatures between 600° and 1200° F. for less than 120 seconds, followed by quenching, rolling and aging.

U.S. Pat. No. 5,356,495 describes a process in which the cast strip is hot-rolled, hot-coiled and held at a hot-rolled temperature for 2–120 minutes, followed by uncoiling, quenching and cold rolling at less than 300° F., followed by recoiling the sheet.

None of the above methods disclose or suggest the sequence of steps of the present invention. There continues to be a need to provide a continuous in-line method of making heat-treated (T temper) and annealed (O temper) sheet having the desired properties in a shorter period of time, with less or no inventory and less scrap losses.

SUMMARY OF THE INVENTION

The present invention solves the above need by providing a method of manufacturing aluminum alloy sheet in a continuous in-line sequence comprising (i) providing a continuously-cast aluminum alloy strip as feedstock; (ii) optionally quenching the feedstock to the preferred hot rolling temperature; (iii) hot or warm rolling the quenched feedstock to the required thickness, (iv) annealing or solution heat-treating the feedstock in-line, depending on alloy and temper desired; and (v) optionally, quenching the feedstock. Preferably, additional steps include tension leveling and coiling.

This method allows the elimination of many steps and much processing time, and yet still results in an aluminum alloy sheet having all of the desired properties. Both heat-treated and O temper products are made in the same production line which takes about 30 seconds to convert molten metal to finished coil. It is an object of the present invention, therefore, to provide a continuous in-line method of making aluminum alloy sheet having properties similar to or exceeding those provided with conventional methods.

It is an additional object of the present invention to provide a continuous in-line method of making aluminum alloy sheet more quickly so as to minimize waste and processing time.

It is a further object of the present invention to provide a continuous in-line method of making aluminum alloy sheet, in a more efficient and economical process.

These and other objects of the present invention will become more readily apparent from the following figures, detailed description and appended claims.

BRIEF DESCRIPTION OF THE DRAWINGS

The invention is further illustrated by the following drawings in which.

DETAILED DESCRIPTION OF PREFERRED EMBODIMENTS

Figure 1:
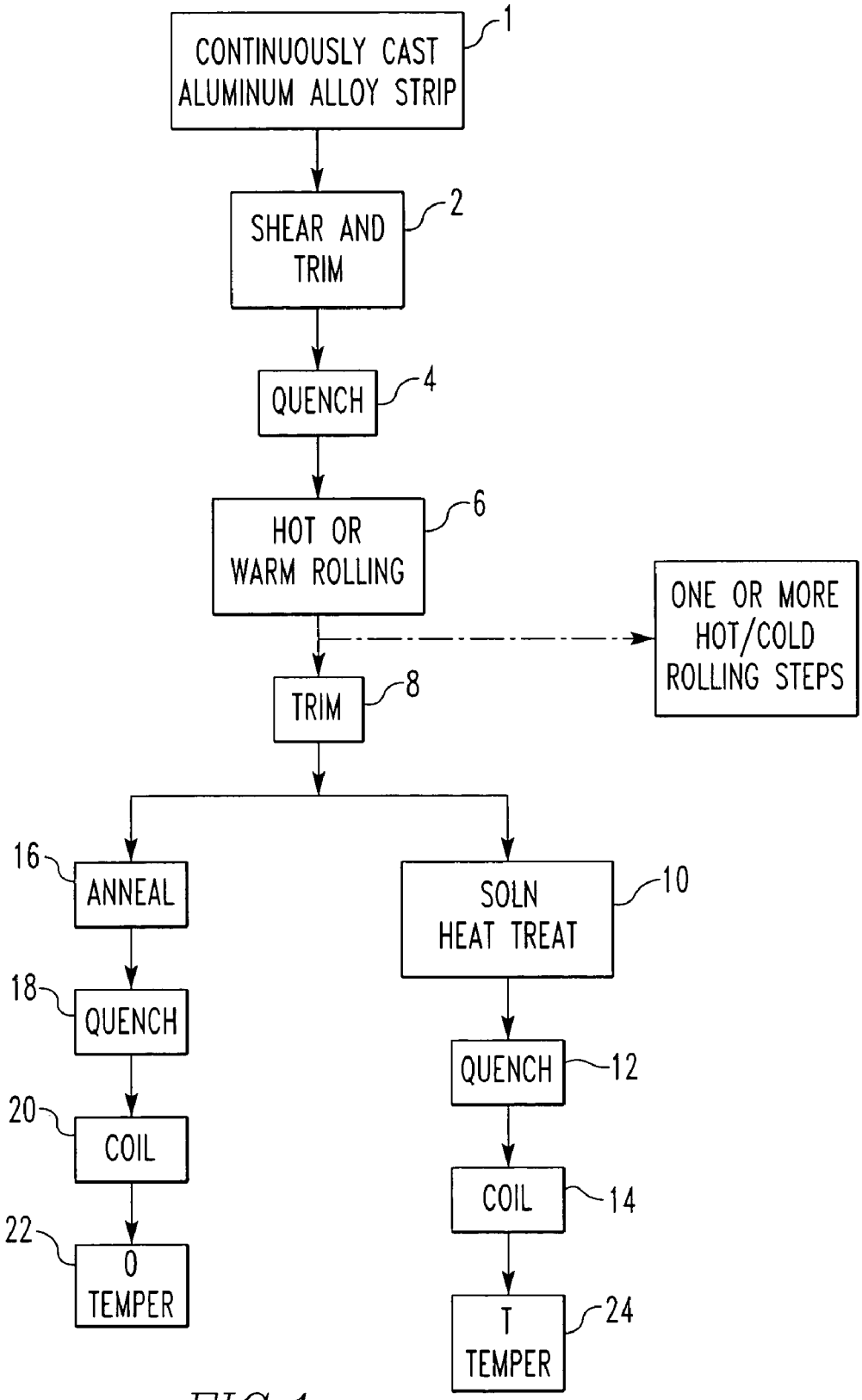
FIG. 1 is a flow chart of the steps of the method of the present invention, in one embodiment.

The present invention provides a method of manufacturing aluminum alloy sheet in a continuous in-line sequence comprising: (i) providing a continuously-cast thin aluminum alloy strip as feedstock; (ii) optionally, quenching the feedstock to the preferred hot or warm rolling temperature; (iii) hot or warm rolling the quenched feedstock to the desired final thickness; (iv) annealing or solution heat-treating the feedstock in-line, depending on alloy and temper desired; and (v) optionally, quenching the feedstock, after which it is preferably tension-leveled and coiled. This method results in an aluminum alloy sheet having the desired dimensions and properties. In a preferred embodiment, the aluminum alloy sheet is coiled for later use. This sequence of steps is reflected in the flow diagram of FIG. 1, which shows a continuously-cast aluminum alloy strip feedstock 1 which is optionally passed through shear and trim stations 2, optionally quenched for temperature adjustment 4, hot-rolled 6, and optionally trimmed 8. The feedstock is then either annealed 16 followed by suitable quenching 18 and optional coiling 20 to produce O temper products 22, or solution heat treated 10, followed by suitable quenching 12 and optional coiling 14 to produce T temper products 24. As can be seen in FIG. 1, the temperature of the heating step and the subsequent quenching step will vary depending on the desired temper.

As used herein, the tern "anneal" refers to a heating process that causes recrystallization of the metal to occur, producing uniform formability and assisting in earing control. Typical temperatures used in annealing aluminum alloys range from about 6000 to 900° F.

Also as used herein, the tern "solution heat treatment" refers to a metallurgical process in which the metal is held at a high temperature so as to cause the second phase particles of the alloying elements to dissolve into solid solution. Temperatures used in solution heat treatment are generally higher than those used in annealing, and range up to about 1060° F. This condition is then maintained by quenching of the metal for the purpose of strengthening the final product by controlled precipitation (aging).

As used herein, the term "feedstock" refers to the aluminum alloy in strip form. The feedstock employed in the practice of the present invention can be prepared by any number of continuous casting techniques well known to those skilled in the art. A preferred method for making the strip is described in U.S. Pat. No. 5,496,423 issued to Wyatt-Mair and Harrington. Another preferred method is as described in applications Ser. No. 10/078,638 (now U.S. Pat. No. 6,672,368) and Ser. No. 10/377,376, both of which are assigned to the assignee of the present invention. The continuously-cast aluminum alloy strip preferably ranges from about 0.06 to 0.25 inches in thickness, more preferably about 0.08 to 0.14 inches in thickness. Typically, the cast strip will have a width up to about 90 inches, depending on desired continued processing and the end use of the sheet.

Figure 2:
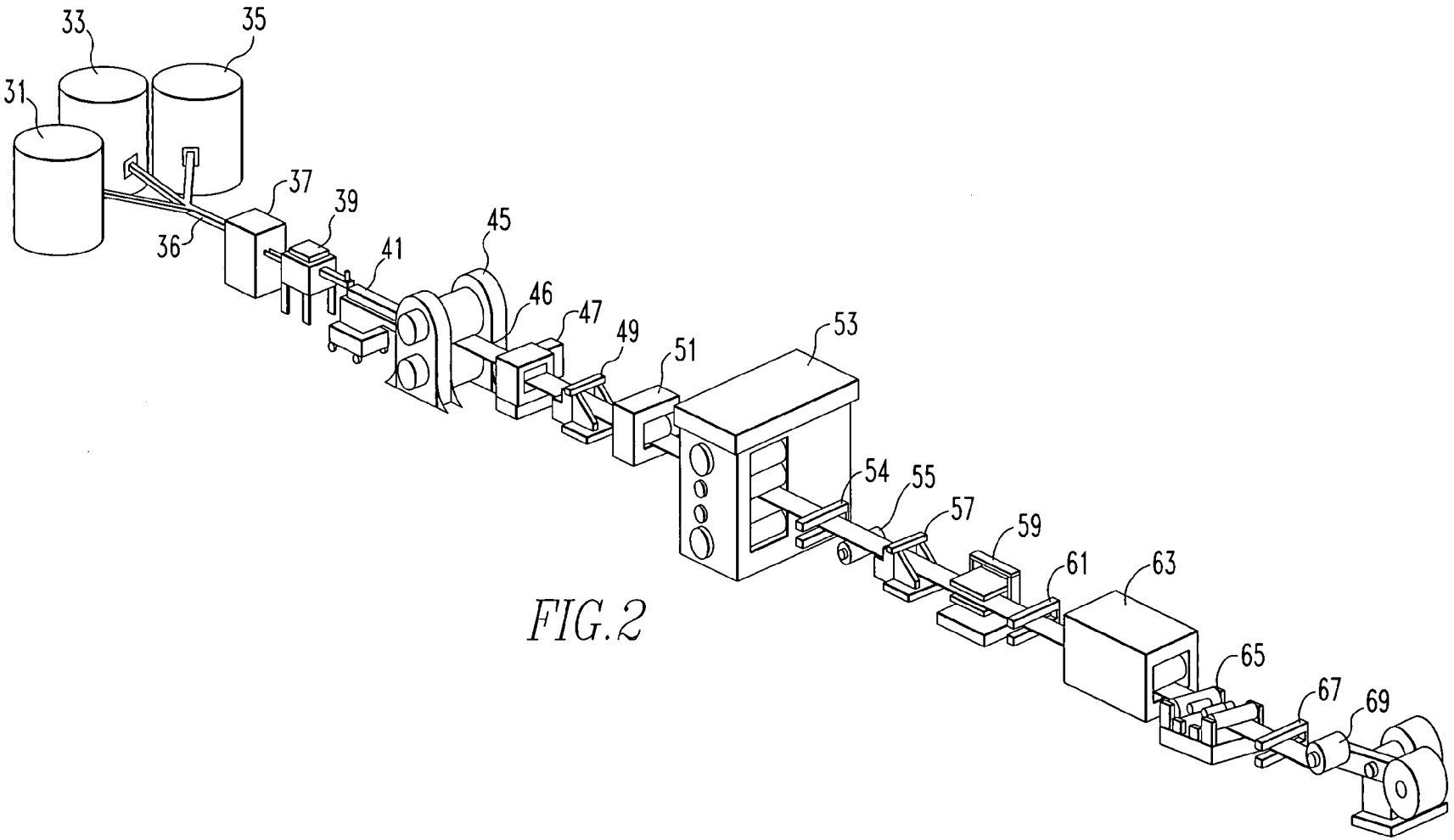
FIG. 2 is a schematic diagram of one embodiment of the apparatus used in carrying out the method of the present invention.

Referring now to FIG. 2, there is shown schematically a preferred apparatus used in carrying out a preferred embodiment of the method of the present invention. Molten metal to be cast is held in melter holders 31, 33 and 35, is passed through troughing 36 and is further prepared by degassing 37 and filtering 39. The tundish 41 supplies the molten metal to the continuous caster 45. The metal feedstock 46 which emerges from the caster 45 is moved through optional shear 47 and trim 49 stations for edge trimming and transverse cutting, after which it is passed to a quenching station 51 for adjustment of rolling temperature. The shear station is operated when the process in interrupted; while running, shear is open.

After optional quenching 51, the feedstock 46 is passed through a rolling mill 53, from which it emerges at the required final thickness. The feedstock 46 is passed through a thickness gauge 54, a shapemeter 55, and optionally trimmed 57, and is then annealed or solution heat-treated in a heater 59.

Following annealing/solution heat treatment in the heater 59, the feedstock 46 passes through a profile gauge 61, and is optionally quenched at quenching station 63. Additional steps include passing the feedstock 46 through a tension leveler to flatten the sheet at station 65, and subjecting it to surface inspection at station 67. The resulting aluminum alloy sheet is then coiled at the coiling station 69. The overall length of the processing line from the caster to the coiler is estimated at about 250 feet. The total time of processing from molten metal to coil is therefore about 30 seconds.

Any of a variety of quenching devices may be used in the practice of the present invention. Typically, the quenching station is one in which a cooling fluid, either in liquid or gaseous form is sprayed onto the hot feedstock to rapidly reduce its temperature. Suitable cooling fluids include water, air, liquefied gases such as carbon dioxide, and the like. It is preferred that the quench be carried out quickly to reduce the temperature of the hot feedstock rapidly to prevent substantial precipitation of alloying elements from solid solution.

In general, the quench at station 51 reduces the temperature of the feedstock as it emerges from the continuous caster from a temperature of about 1000° F. to the desired hot or warm rolling temperature. In general, the feedstock will exit the quench at station 51 with a temperature ranging from about 400° to 900° F., depending on alloy and temper desired. Water sprays or an air quench may be used for this purpose.

Hot or warm rolling 53 is typically carried out at temperatures within the range of about 400° to 1020° F., more preferably 700° to 1000° F. The extent of the reduction in thickness affected by the hot rolling step of the present invention is intended to reach the required finish gauge. This typically involves a reduction of about 55%, and the as-cast gauge of the strip is adjusted so as to achieve this reduction. The temperature of the sheet at the exit of the rolling station is between about 3000 and 850° F., more preferably 550° to 800° F., since the sheet is cooled by the rolls during rolling.

Preferably, the thickness of the feedstock as it emerges from the rolling station 53 will be about 0.02 to 0.15 inches, more preferably about 0.03 to 0.08 inches.

The heating carried out at the heater 59 is determined by the alloy and temper desired in the finished product. In one preferred embodiment, for T tempers, the feedstock will be solution heat-treated in-line, at temperatures above about 950° F., preferably about 980–1000° F. Heating is carried out for a period of about 0.1 to 3 seconds, more preferably about 0.4 to 0.6 seconds.

In another preferred embodiment, when O temper is desired, the feedstock will require annealing only, which can be achieved at lower temperatures, typically about 700° to 950° F., more preferably about 800°–900° F., depending upon the alloy. Again, heating is carried out for a period of about 0.1 to 3 seconds, more preferably about 0.4 to 0.6 seconds.

Similarly, the quenching at station 63 will depend upon the temper desired in the final product. For example, feedstock which has been solution heat-treated will be quenched, preferably air and water quenched, to about 110° to 250° F., preferably to about 160°–180° F. and then coiled. Preferably, the quench at station 63 is a water quench or an air quench or a combined quench in which water is applied first to bring the temperature of the sheet to just above the Leidenfrost temperature (about 550° F. for many aluminum alloys) and is continued by an air quench. This method will combine the rapid cooling advantage of water quench with the low stress quench of airjets that will provide a high quality surface in the product and will minimize distortion. For heat treated products, an exit temperature of 200° F. or below is preferred.

Products that have been annealed rather than heat-treated will be quenched, preferably air- and water-quenched, to about 110° to 720° F., preferably to about 680° to 700° F. for some products and to lower temperatures around 200° F. for other products that are subject to precipitation of intermetallic compounds during cooling, and then coiled.

Although the process of the invention described thus far in one embodiment having a single step hot or warm rolling to reach the required final gauge, other embodiments are contemplated, and any combination of hot and cold rolling may be used to reach thinner gauges, for example gauges of about 0.007–0.075 inches. The rolling mill arrangement for thin gauges could comprise a hot rolling step, followed by hot and/or cold rolling steps as needed. In such an arrangement, the anneal and solution heat treatment station is to be placed after the final gauge is reached, followed by the quench station. Additional in-line anneal steps and quenches may be placed between rolling steps for intermediate anneal and for keeping solute in solution, as needed. The pre-quench before hot rolling needs to be included in any such arrangements for adjustment of the strip temperature for grain size control. The pre-quench step is a pre-requisite for alloys subject to hot shortness.

Figure 3:
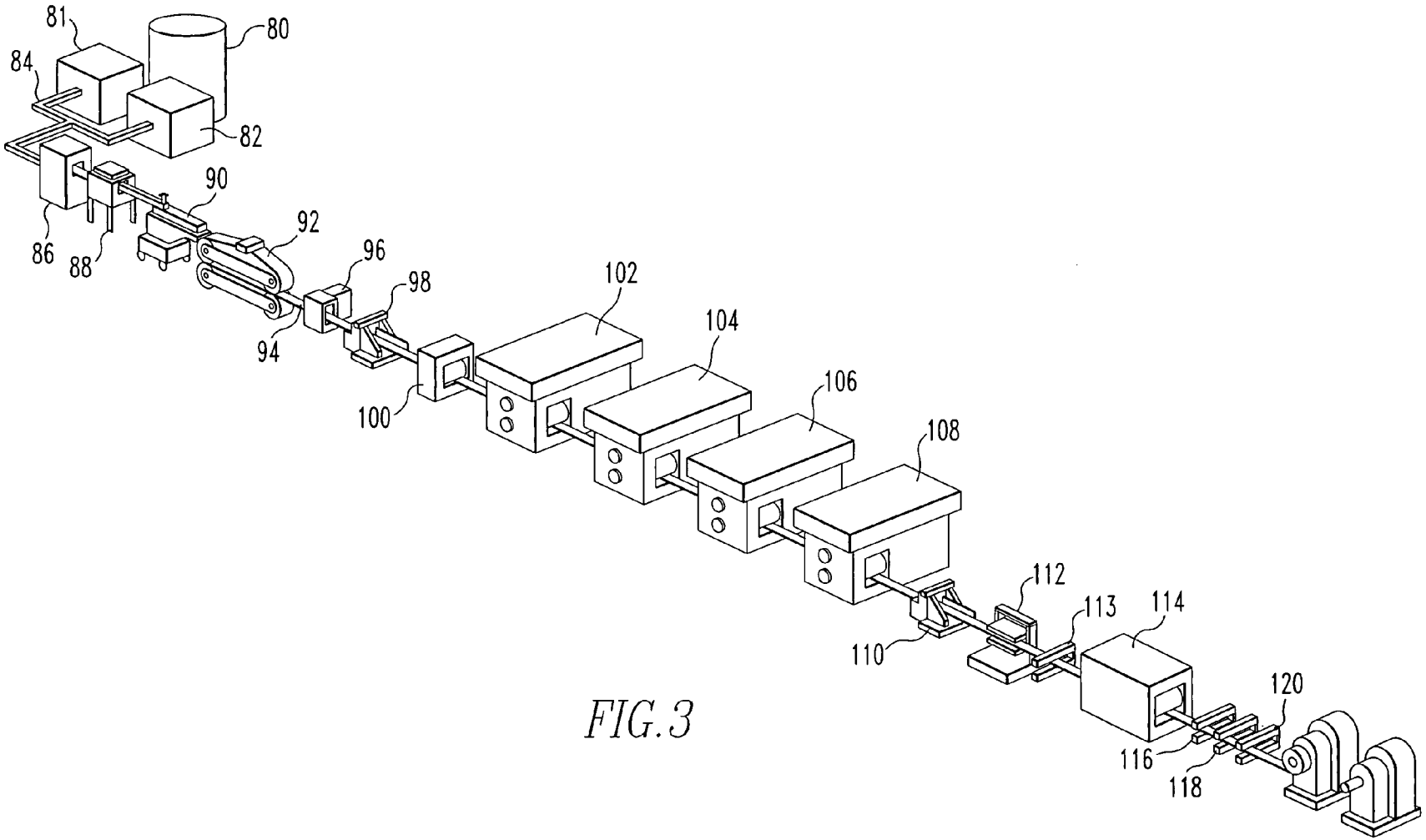
FIG. 3 is an additional embodiment of the apparatus used in carrying out the method of the present invention. This line is equipped with four rolling mills to reach a finer finished gauge.

FIG. 3 shows schematically an apparatus for one of many alternative embodiments in which additional heating and rolling steps are carried out. Metal is heated in a furnace 80 and the molten metal is held in melter holders 81, 82. The molten metal is passed through troughing 84 and is further prepared by degassing 86 and filtering 88. The tundish 90 supplies the molten metal to the continuous caster 92, exemplified as a belt caster, although not limited to this. The metal feedstock 94 which emerges from the caster 92 is moved through optional shear 96 and trim 98 stations for edge trimming and transverse cutting, after which it is passed to an optional quenching station 100 for adjustment of rolling temperature.

After quenching 100, the feedstock 94 is passed through a hot rolling mill 102, from which it emerges at an intermediate thickness. The feedstock 94 is then subjected to additional hot milling 104 and cold milling 106, 108 to reach the desired final gauge.

The feedstock 94 is then optionally trimmed 110 and then annealed or solution heat-treated in heater 112. Following annealing/solution heat treatment in the heater 112, the feedstock 94 optionally passes through a profile gauge 113, and is optionally quenched at quenching station 114. The resulting sheet is subjected to x-ray 116, 118 and surface inspection 120 and then optionally coiled.

Suitable aluminum alloys for heat-treatable alloys include, but are not limited to those of the 2XXX, 6XXX and 7XXX Series. Suitable non-heat-treatable alloys include, but are not limited to, those of the 1XXX, 3XXX and 5XXX Series. The present invention is applicable also to new and non-conventional alloys as it has a wide operating window both with respect to casting, rolling and in-line processing.

EXAMPLES

The following examples are intended to illustrate the invention and should not be construed as limiting the invention in any way.

Example 1

In-line fabrication of a heat-treatable alloy. A heat-treatable aluminum alloy was processed in-line by the method of the present invention. The composition of the cast was selected from the range of 6022 Alloy that is used for auto panels. The analysis of the melt was as follows:

| Element | Percentage by weight |
|---|---|
| Si | 0.8 |
| Fe | 0.1 |
| Cu | 0.1 |
| Mn | 0.1 |
| Mg | 0.7 |

The alloy was cast to a thickness of 0.085 inch at 250 feet per minute speed and was processed in line by hot rolling in one step to a finish gauge of 0.035 inches, followed by heating to a temperature of 980° F. for 1 second for solution heat treatment after which it was quenched to 160° F. by means of water sprays and was coiled. Samples were then removed from the outermost wraps of the coil for evaluation. One set of samples was allowed to stabilize at room temperature for 4–10 days to reach T4 temper. A second set was subjected to a special pre-aging treatment at 180° F. for 8 hours before it was stabilized. This special temper is called T43. The performance of the samples was evaluated by several tests that included response to hemming, uniaxial tension, equi-biaxial stretching (hydraulic bulge) and aging in an auto paint-bake cycle. The results obtained were compared with those obtained on sheet of the same alloy made by the conventional ingot method. Deformed samples from the hydraulic bulge test were also subjected to a simulated auto painting cycle to check for surface quality and response to painting. In all respects, the sheet fabricated in-line by the present method performed as well as or better than that from the ingot method.

TABLE 1

Tensile properties of 6022-T43 sheet fabricated in line by the present method. Measurements were made after nine days of natural aging on ASTM specimens. Cast number: 031009.

| pre-roll quench | TFX F | in line quench, F. | ATC S number | TYS ksi | UTS ksi | Elongation, % uniform | Elongation, % total | r value | r bar |
|---|---|---|---|---|---|---|---|---|---|
| | | | | T43 (longitudinal) | | | | | |
| off | 980 | 114 | 805656 | 18.6 | 36.6 | 25.5 | 30.4 | 1.079 | |
| off | 1000 | 114 | 805658 | 19.3 | 37.2 | 23.6 | 26.7 | 1.144 | |
| Sheet from conventional ingot -3 T43 | | | typical | 17.8 | 34.5 | 21.5 | 24.5 | 0.826 | |
| | | | | T43 (45°) | | | | | |
| off | 980 | 114 | 805656 | 18.5 | 36.4 | 24.2 | 28.0 | 0.760 | |
| off | 1000 | 114 | 805658 | 19.6 | 37.6 | 25.4 | 29.7 | 0.725 | |
| Sheet from conventional ingot - T43 | | | typical | 17.0 | 33.4 | 24.5 | 26.9 | 0.602 | |
| | | | | T43 (transverse) | | | | | |
| off | 980 | 114 | 805656 | 18.4 | 36.2 | 22.1 | 24.5 | 0.988 | 0.897 |
| off | 1000 | 114 | 805658 | 19.0 | 36.7 | 23.6 | 26.3 | 0.889 | 0.896 |
| Sheet from conventional ingot - T43 | | | typical | 16.6 | 32.5 | 22.8 | 26.4 | 0.642 | 0.668 |
| Customer requirements (min) | | | | 14.0 | | 19.0 | 21.0 | | 0.500 |

Notes:
1. T43 temper was obtained by holding samples at 180 F. for 8 hours in a separate furnace after fabrication The time between fabrication and entry of samples into furnace was less than 10 minutes.

Results of the tensile testing are shown in Table 1 for T43 temper sheet in comparison with those typical for sheet made from ingot. It is noted that in all respects, the properties of the sheet made by the present method exceeded the customer requirements and compared very well with those for conventional sheet in the same temper. With respect to the isotropy of the properties as measured by the r values, for example, the sheet of the present method obtained 0.897 compared to 0.668 for ingot. In these tests, a generally higher strain hardening coefficient of 0.27 (compared to 0.23 for ingot) was also found. Both of these two findings are important because they suggest that the sheet of the present method is more isotropic and better able to resist thinning during forming operations. Similar observations applied also to T4 temper sheet samples.

Flat hemming tests were done after 28 days of room temperature aging. In these tests, a pre-stretch of 11% was applied compared to 7% required in customer specifications. Even under these more severe conditions, all samples obtained an acceptable rating of 2 or 1, Table 2. In similar testing, sheet made from ingot shows an average of 2–3 in the longitudinal hems and 2 in transverse hems. This suggests that the sheet fabricated in-line has superior hemmability. Some samples were solution heat-treated off-line in a salt bath after fabrication. When tested, these samples, too, showed excellent hemming performance as seen in Table 2.

TABLE 2

Flat hem rating (at 11% pre-stretch) after 28 days' of natural aging for alloy 6022 at 0.035 inch gauge (cast number: 030820)

| pre-roll quench | in-line anneal, F. | in line quench, F. | gauge inches | ATC S number | hem rating L | hem rating T | comments |
|---|---|---|---|---|---|---|---|
| | | | | C710 - T43 temper | | | |
| off | 950 | 160 | 0.035 | 804908 | 2 | 2 | fabricated in line |
| off | 950 | 160 | 0.035 | 804909 | 2 | 2 | fabricated in line |
| on | off | 104 | 0.035 | 804912 | 1 | 2 | off-line heat treat: 1040 F./1 min. |
| on | 920 | 140 | 0.035 | 804914 | 2 | 2 | off-line heat treat: 1010 F./1 min. |
| Conventional ingot sheet - T43 temper | | | | | "2–3" | 2 | |

Notes:
1. T43 temper was obtained by holding samples at 180 F. for 8 hours in a separate furnace after fabrication The time between fabrication and entry of samples into furnace was less than 10 minutes.
2. Requirement for hemming: A rating of 2 or less at 7% pre-stretch.

Figure 4A:
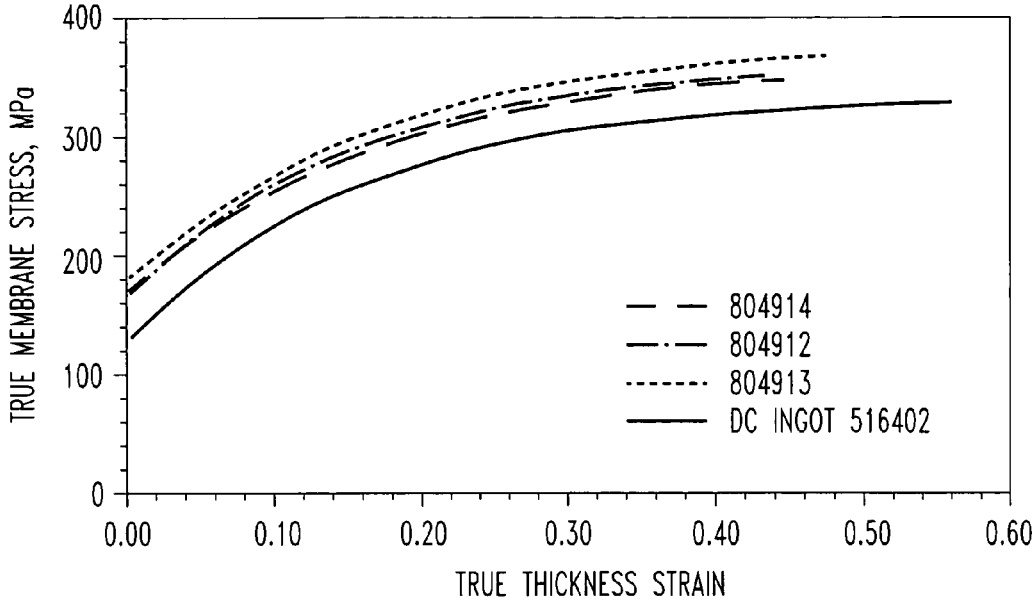
FIG. 4*a* is a graph demonstrating the equi-biaxial stretching performance of 6022-T43 sheet (0.035 inch gauge) made in-line compared with sheet made from DC ingot and heat-treated off-line.
Figure 4B:
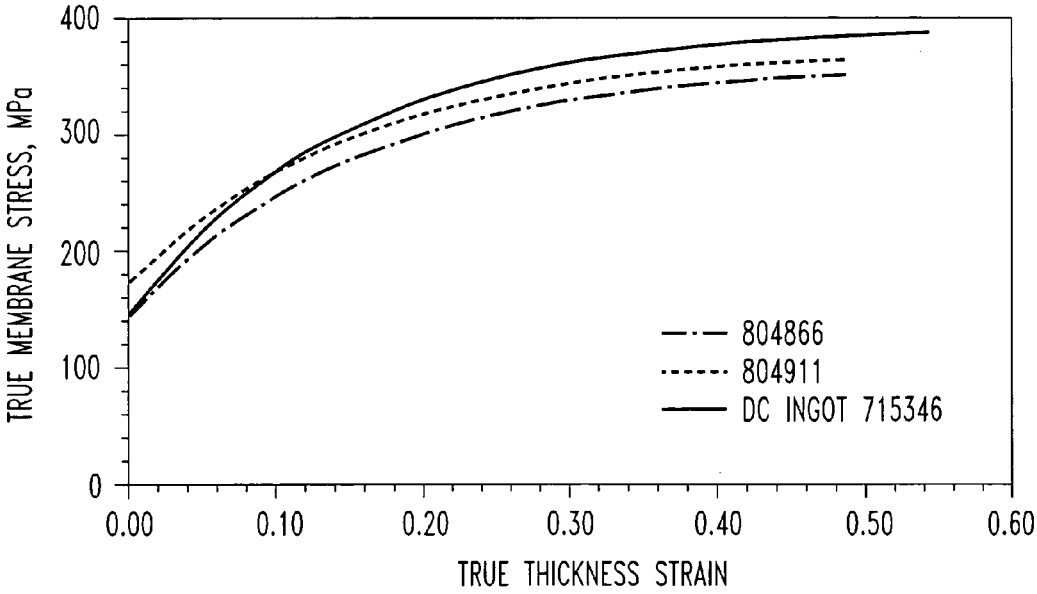
FIG. 4*b* is a graph demonstrating the equi-biaxial stretching performance of 6022-T4 Alloy made in-line compared with sheet made from DC ingot and heat-treated off-line.

In equi-biaxial stretching by hydraulic bulge, the performance of the sheet made in line was comparable to those of sheet made from ingot as seen in stress strain curves in FIGS. 4*a* and 4*b*. This observation applied both in T4 and in T43 temper. The performance in this test was particularly important because it is known that continuous-cast materials typically do not perform well in this test due to the presence of center line segregation of coarse intermetallic particles.

Response to paint-bake cycle was evaluated by holding the samples in an oven at 338° F. for a duration of 20 minutes (Nissan cycle). The tensile yield strength of the samples increased by up to 13 ksi by this treatment, Table 3. In all cases, the required minimum of 27.5 ksi was met easily in the T43 temper. The overall response in this temper was comparable to the average performance of sheet made from DC ingot. As expected, the T4 temper samples were somewhat unsatisfactory in this respect.

TABLE 3

Paint bake response of alloy C710 produced in Reno at rolled gauge of 0.035 inches. Cast number: 030820. Nissan/Toyota paint bake cycle: 2% stretch, 338 F./20 minutes. TYS required: 27.5 ksi min.

| pre-roll | in line | | | Date | | Natural Age | Sample | TYS | UTS | | ΔYS |
|---|---|---|---|---|---|---|---|---|---|---|---|
| quench | TFX F | quench, F. | Temper | SHT | Test | Days | ID | ksi | ksi | Elong % | ksi |
| | | | T4 | 20-Aug | 27-Aug | 7 | 804866-T | 16.9 | 33.8 | 23.2 | |
| off | 950 | 160 | T4 + PB | in line | | 7 | 804866-T | 25.8 | 37.7 | 20.8 | 8.9 |
| | | | T4 | 20-Aug | 27-Aug | 7 | 804867-T | 16.8 | 34.0 | 23.0 | |
| off | 950 | 160 | T4 + PB | in line | | 7 | 804867-T | 26.0 | 37.8 | 20.2 | 9.2 |
| | | | T43 | 20-Aug | 27-Aug | 7 | 804908-T | 16.8 | 33.8 | 22.0 | |
| off | 950 | 160 | T43 + PB | in line | | 7 | 804908-T | 27.6 | 39.0 | 19.5 | 10.8 |
| | | | T43 | 20-Aug | 27-Aug | 7 | 804909-T | 16.6 | 33.8 | 25.0 | |
| off | 950 | 160 | T43 + PB | in line | | 7 | 804909-T | 29.6 | 40.5 | 19.5 | 13.0 |
| | | | T43 | 21-Aug | 27-Aug | 6 | 804912-T | 18.4 | 35.2 | 24.2 | |
| on | off | 104 | T43 + PB | 1040/1 min | | 6 | 804912-T | 28.9 | 40.5 | 23.8 | 10.5 |
| | | | T43 | 22-Aug | 27-Aug | 5 | 804914-T | 18.6 | 35.2 | 25.0 | |
| on | 920 | 140 | T43 + PB | 1010/1 min | | 5 | 804914-T | 30.1 | 41.1 | 22.5 | 11.5 |
| | | | | DC ingot | T43 | 7 | | 17.1 | 33.3 | 26.3 | |
| | | | | typical | T43 + PB | 7 | JIS tests | 30.5 | 40.9 | 26.4 | 13.4 |

Notes:
1. Samples were held at 180 F. for 8 hours for the T43 temper (quench aged).
2. Samples 804912 and 804914: Laboratory solution heat treat was carried out in a salt bath under conditions indicated followed by water quenching.

Figure 5:
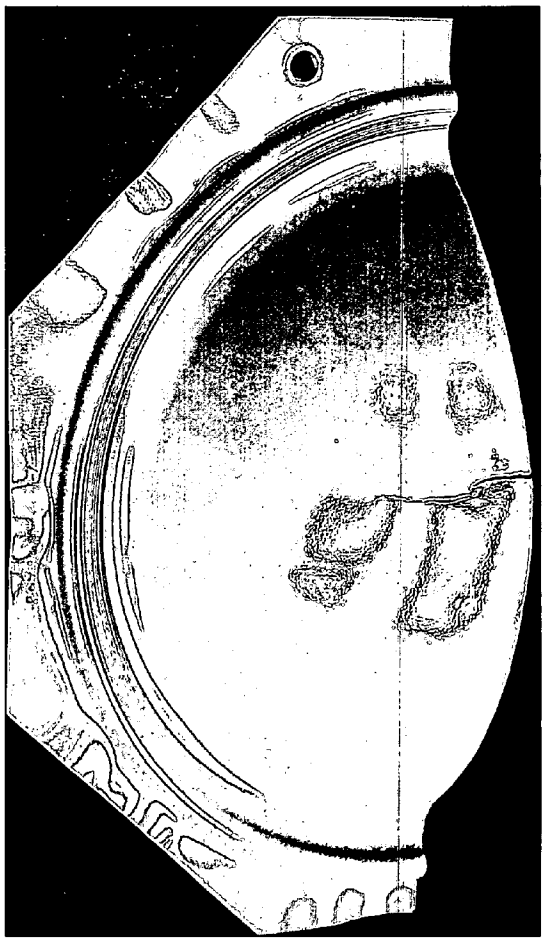
FIG. 5 is a picture of Sample 804908 (Alloy 6022 in T43 temper) after e-coating.

The deformed hydraulic bulge specimens were inspected for surface quality and were found to show no undesirable features such as orange peel, blisters, etc. Selected bulge samples were subjected to a simulated auto-paint cycle. FIG. 5 shows excellent painted surface quality with no paint brush lines, blisters or linear features.

Figure 6A:
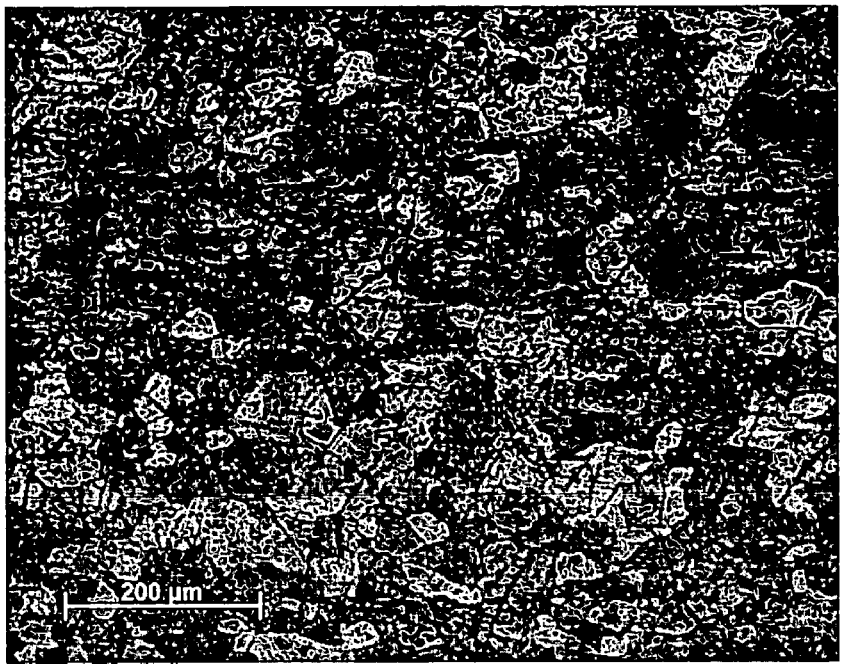
FIG. 6*a* is a picture demonstrating the grain size of Alloy 6022 rolled in-line to 0.035 inch gauge without pre-quench.
Figure 6B:
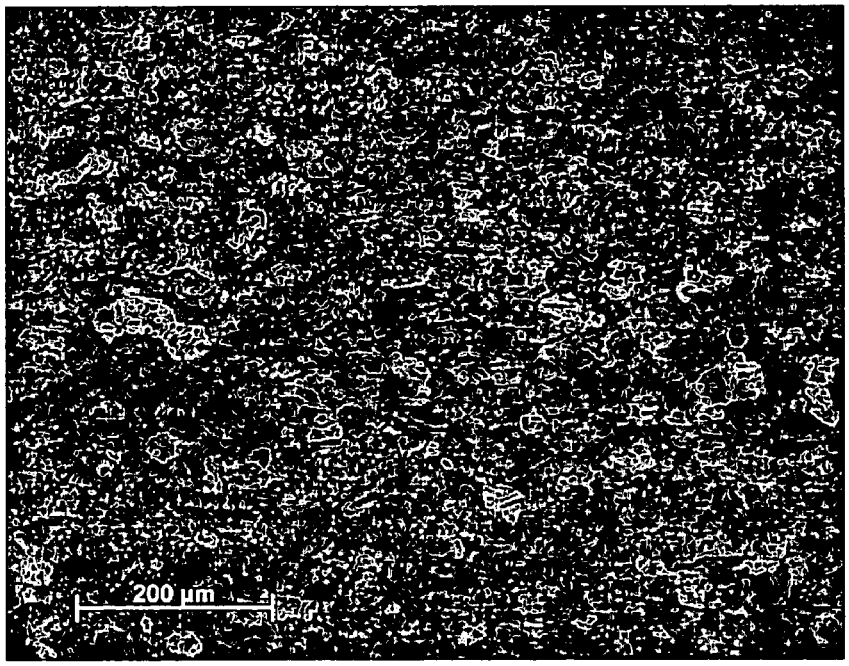
FIG. 6*b* is a picture demonstrating the grain size of Alloy 6022 rolled in-line to 0.035 inch gauge with pre-quench.

Sheet at finished gauge was examined for grain size and was found to have a mean grain size of 27 μm in the longitudinal and 36 μm in the thickness direction, FIG. 6*a*. This is substantially finer than that of 50–55 μm typical for sheet made from ingot. Since a fine grain size is recognized to be generally beneficial, it is likely that a part of the good/superior properties of the sheet made by the present method was due to this factor. It was found that even finer grain size could be obtained in the present method by rapidly cooling the strip to about 700° F. before it is rolled. This effect is illustrated in FIGS. 6*a* and 6*b* where the two samples are shown side by side. The grain size of the cooled sample (6*b*) was 20 μm in longitudinal and 27 μm in transverse direction, which are 7 and 9 μm, respectively, finer than those observed in the sheet which had no pre-quench cooling (FIG. 6*a*).

Figure 7A:
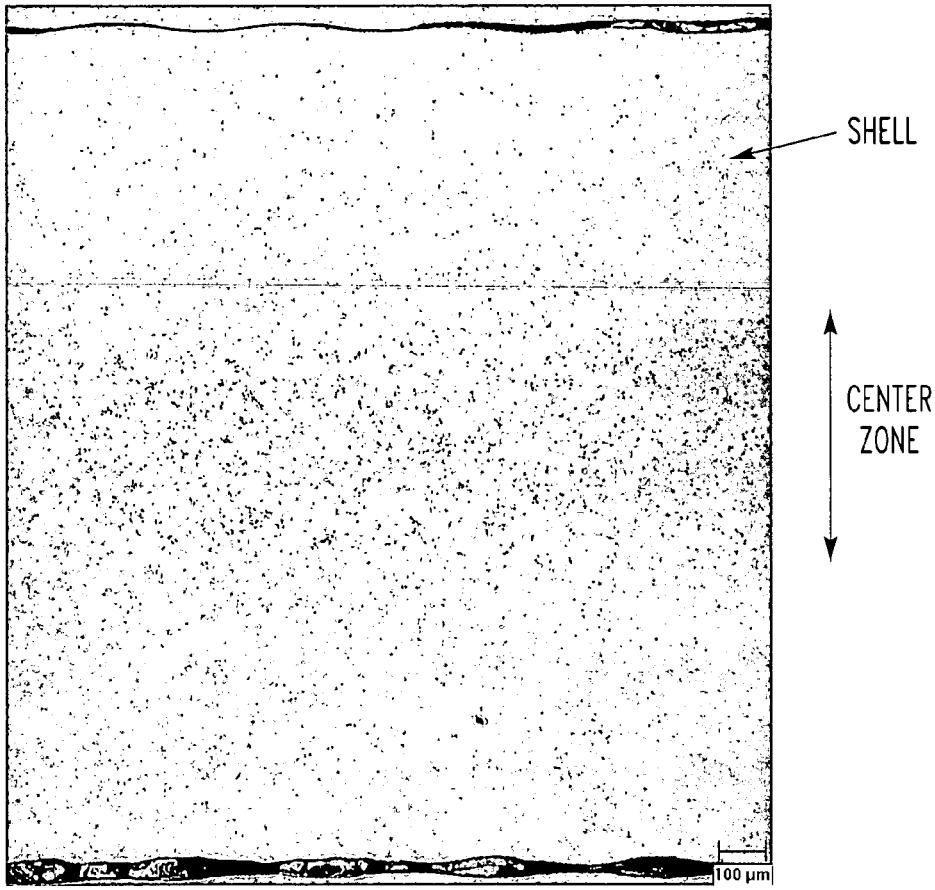
FIG. 7*a* depicts an as-cast structure in Alloy 6022 transverse section.
Figure 7B:
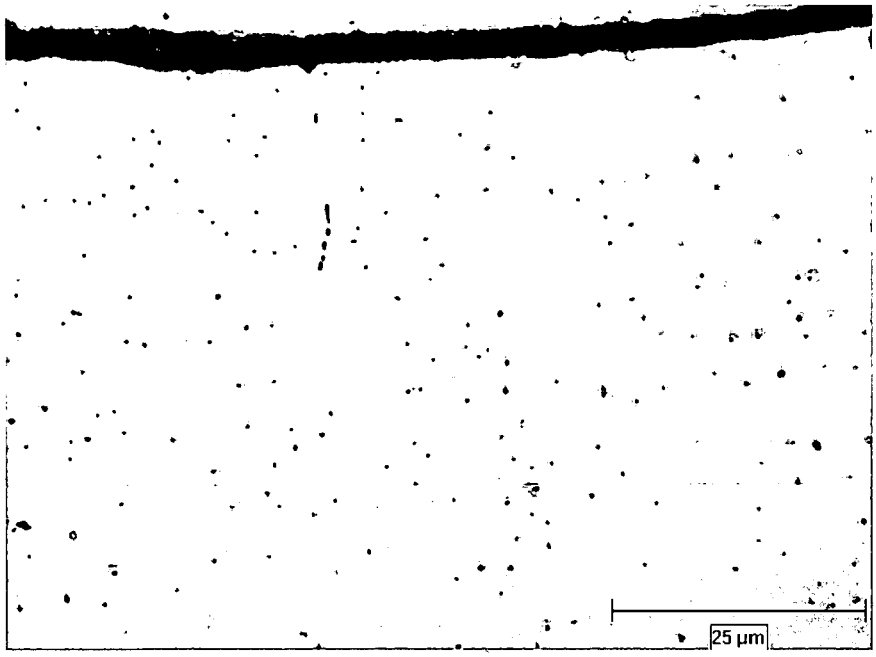
FIGS. 7*b* and 7*c* consist of two micrographs demonstrating the surface and shell structure of Alloy 6022, respectively, in as-cast condition in transverse section.
Figure 7C:
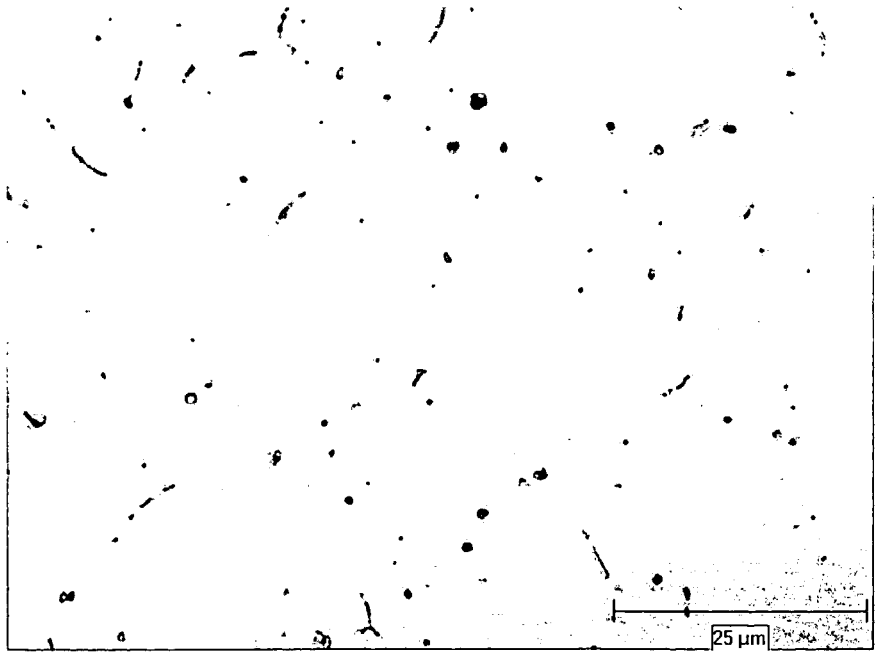
Figure 7D:
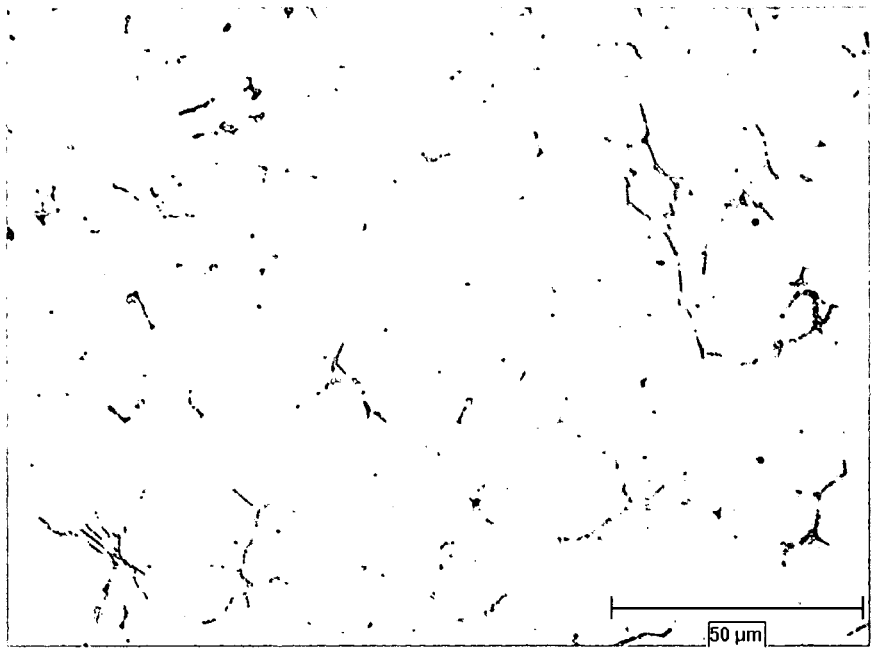
FIGS. 7*d* and 7*e* are micrographs of the center zone structure of Alloy 6022 in as-cast condition in transverse section.
Figure 7E:
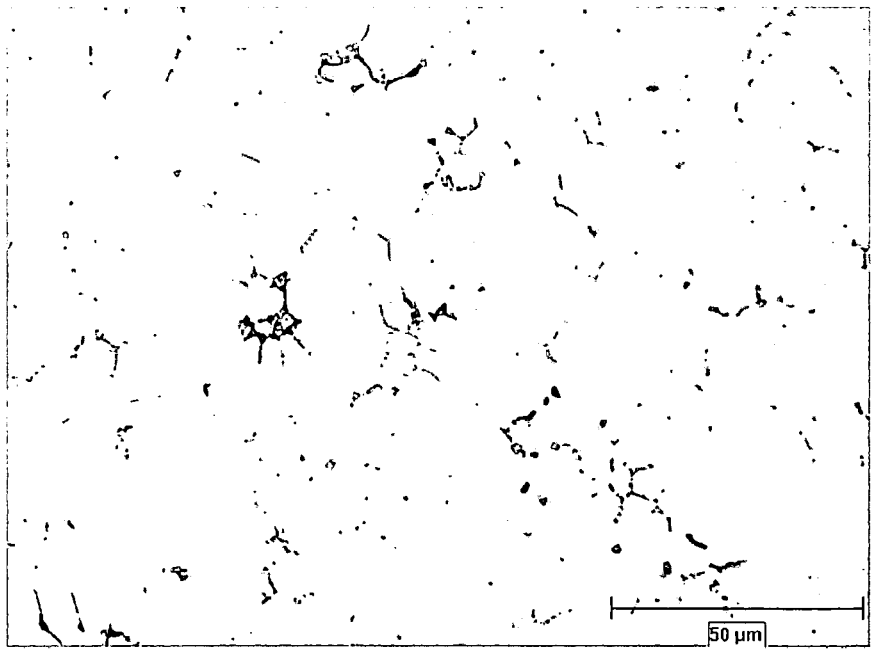
Figure 7F:
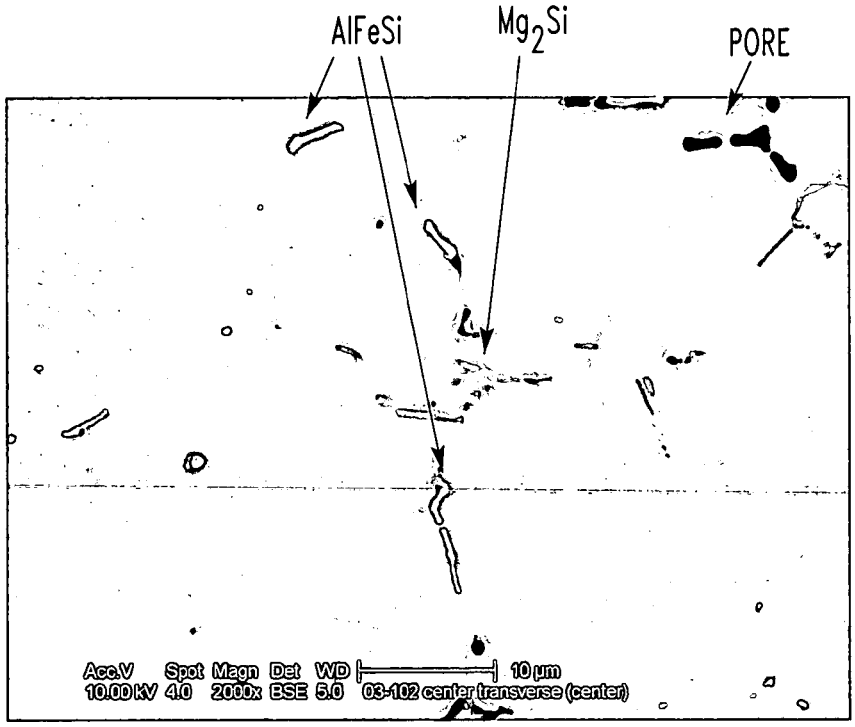
FIGS. 7*f* and 7*g* are micrographs demonstrating occasional small pores and constituents (mainly AlFeSi and some $Mg_2Si$ particles) in the center zone of Alloy 6022 cast structure in transverse section.
Figure 7G:
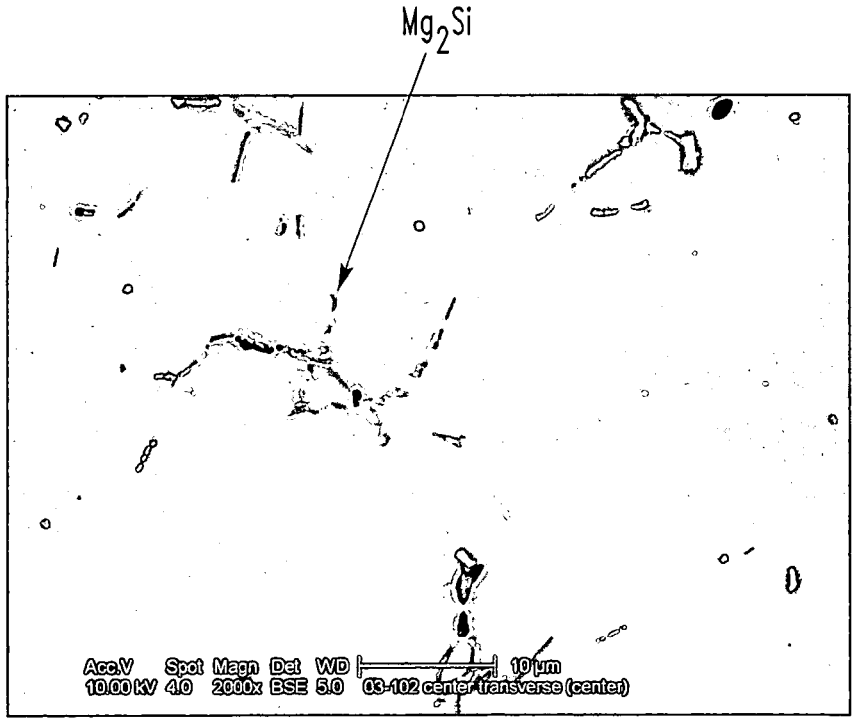

Samples of as-cast strip were quenched and examined metallographically to further understand the benefits of thin strip casting. The samples showed the three-layered structure characteristic of the Alcoa strip casting process, FIG. 7*a*. The surfaces of the strip were clean (no liquation, blisters or other surface defects) with a fine microstructure, FIGS. 7*b* and 7*c*. Unlike the material continuously cast by Hazelett belt casters or roll casters, the strip of the present method showed no centerline segregation of coarse intermetallic compounds. On the contrary, the last liquid to solidify had formed fine second phase particles between grains in a center zone that covered about 25% of the section, FIGS. 7*d* and 7*e*. This absence of a marked centerline segregation in the present method provided the good mechanical properties observed, especially in the equi-biaxial stretch tests. Most of the second phase particles observed were AlFeSi phase with an average size <1 μm, FIGS. 7*f* and 7*g*. Some $Mg_2Si$ particles were seen in the center zone of the sample, but none was noted in the outer "shells", FIGS. 7*b* and 7*c*. This suggested that the rapid solidification in the caster was able to keep the solute in solution in the outer zones of the structure. This factor, combined with the fine overall microstructure of the strip (see Table 4), enabled the complete dissolution of all solute at substantially lower solution heat treatment temperatures of 950°–980° F. than 1060° F. that would be needed for sheet prepared from DC ingot.

TABLE 4

Characteristics of constituent particles and pores found in as -cast samples of alloy C710 (cast number: 030820)

| | pores | | Constituents | |
|---|---|---|---|---|
| location in strip | av. diam. μm | area % | av. diam. μm | area % |
| center, transverse | 0.37 | 0.37 | 0.50 | 0.143 |
| center, longitudinal | 0.38 | 0.34 | 0.31 | 0.077 |
| average | 0.38 | 0.36 | 0.41 | 0.11 |
| shell, transverse | 0.35 | 0.21 | 0.32 | 0.23 |
| shell, longitudinal | 0.33 | 0.25 | 0.28 | 0.19 |
| average | 0.34 | 0.23 | 0.30 | 0.21 |

Notes:
1. The constituents were mainly AlFeSi phase. Small amount of $Mg_2Si$ was also seen in center zone.
2. Each result is average 20 different frames.

Example 2

In-line fabrication of a non-heat treatable alloy. A non-heat-treatable aluminum alloy was processed by the method of the present invention. The composition of the cast was selected from the range of the 5754 Alloy that is used for auto inner panels and reinforcements. The analysis of the melt was as follows:

| Element | Percentage by weight |
|---|---|
| Si | 0.2 |
| Fe | 0.2 |
| Cu | 0.1 |
| Mn | 0.2 |
| Mg | 3.5 |

The alloy was cast to a strip thickness of 0.085 inch at 250 feet per minute speed. The strip was first cooled to about 700° F. by water sprays placed before the rolling mill, after which it was immediately processed in-line by hot rolling in one step to a finish gauge of 0.040 inches, followed by heating to a temperature of 900° F. for 1 second for recrystallization anneal after which it was quenched to 190° F. by means of water sprays and was coiled. The performance of the samples was evaluated by uniaxial tensile tests and by limiting dome height (LDH).

Results of the tensile testing are shown in Table 5. The TYS and elongation of the sample in the longitudinal direction were 15.2 ksi and 25.7%, respectively, well above the minimum of 12 ksi and 17% required for Alloy 5754. UTS value was 35.1 ksi, in the middle of the range specified as 29–39 ksi. In the limiting dome height test, a value of 0.952 inch was measured that met the required minimum of 0.92 inch. These values compared well with typical properties reported for sheet prepared from DC ingot. Sheet of the present invention had a higher elongation, higher UTS and higher strain hardening coefficient n. A higher anisotropy value r was expected, but was not verified in the testing of this sample. The r value was 0.864 compared to 0.92 for DC sheet.

Sheet at finished gauge was examined for grain size and was found to have a mean grain size of 11–14 μm (ASTM 9.5). This is substantially finer than that of 16 μm typical for sheet made from ingot. Since a fine grain size is recognized to be generally beneficial, it is likely that a part of the good/superior properties of the sheet made by the present method was due to this factor.

Samples of as-cast strip were quenched and examined metallographically.

Figure 8:
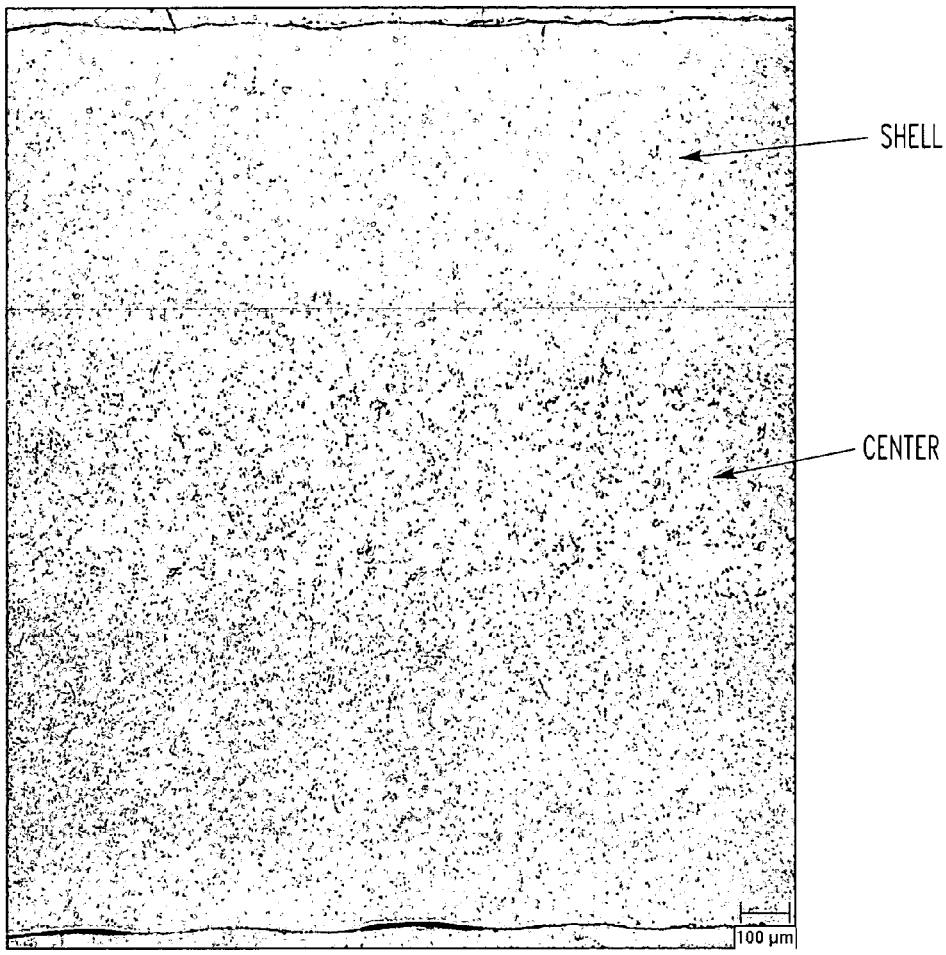
FIG. 8 depicts the as-cast microstructure of Al+3.5% Mg alloy in transverse direction.

Despite differences in chemical composition, the as-cast samples showed the same three-layered structure as that described above for Alloy 6022, FIG. 8. This confirms that the three-layered fine microstructure that enables in-line processing of the strip described in this invention, is a characteristic of the Alcoa strip casting process.

Variations of the fabrication path were also investigated. In one test, 0.049 inch gauge sheet was fabricated in-line without the in-line anneal, Table 5. The sample was then flash-annealed off-line in a salt bath at 975° F. for 15 s followed by water quenching. That sample showed similar properties and a high r value comparable to those described above for sheet fabricated with in-line anneal. This equivalence conformed that in-line fabrication is able to develop the full properties of the alloy in O-temper. In another test, the strip was hot rolled in-line to 0.049 inch gauge and was quenched to 160° F. with no in-line anneal. It was then cold-rolled to 0.035 inch gauge and was flash-annealed at 950° F. for 15 seconds, Table 5. That sheet, too, developed good mechanical properties. These observations suggested that hot and cold rolling could be combined with an-in line final anneal to make sheet of a wide range of thickness of O-temper products by the present invention.

TABLE 5

Uniaxial tensile test results for Al-3.5% Mg AX alloy processed in line by the present invention.

| S number | Reno cast # | alloy | test gauge, inch | hot roll gauge, inch | flow path pre-roll quench | anneal, F. | quench, F. | L 45 T | TYS ksi | UTS ksi | elongation, % uniform | total | r value | r bar | n value |
|---|---|---|---|---|---|---|---|---|---|---|---|---|---|---|---|
| 805314 | 030902B | Al-3.5% Mg | 0.033 | 0.049 | on | off | on | L | 16.5 | 36.2 | 17.9 | 22.3 | 0.781 | 0.947 | 0.309 |
| | | | | | | | | 45 | 16.8 | 35.3 | 24.1 | 28.8 | 1.120 | | 0.311 |
| | | | | | | | | T | 16.1 | 35.6 | 21.3 | 22.2 | 0.766 | | 0.306 |
| 805035 | 030902B | Al-3.5% Mg | 0.049 | 0.049 | on | off | on | L | 15.6 | 35.9 | 19.2 | 20.8 | 0.835 | 1.05 | 0.314 |
| | | | | | | | | 45 | 15.4 | 35.5 | 21.7 | 22.5 | 1.200 | | 0.303 |
| | | | | | | | | T | 15.8 | 35.8 | 22.4 | 26.9 | 0.963 | | 0.317 |
| 805747 | 31021 | Al-3.5% Mg | 0.040 | 0.040 | on | 900 | 190 | L | 15.2 | 35.1 | 23.2 | 25.7 | 0.778 | 0.864 | 0.323 |
| | | | | | | | | 45 | 14.6 | 34.8 | 23.1 | 25.3 | 0.938 | | 0.326 |
| | | | | | | | | T | 14.6 | 34.7 | 23.2 | 24.5 | 0.802 | | 0.322 |
| | | | | | Alloy 5754 for comparison | | | | | | | | | | |
| | DC ingot | 5754 | 0.036 | | | | | L | 14.6 | 29.7 | 20.4 | 22.2 | 0.978 | 0.92 | 0.301 |
| | | | | | | | | 45 | 14.4 | 28.9 | 21.2 | 22.0 | 0.809 | | 0.303 |
| | | | | | | | | T | 14.6 | 28.9 | 19.7 | 22.4 | 1.082 | | 0.305 |

Notes:

1. AA registered requirements for 5754: TYS = 12 ksi min. (L). UTS = 29–39 ksi (L). Elongation: 17% min (L). LDH = 0.92 inches min.

2. Samples 805314 and 805035 were annelaed off-line in a salt bath at 950 Fand 975 F. respectively. for 15 seconds following which they were quenched in water.

Example 3

In-line fabrication of a non-heat-treatable ultra high Mg alloy. An Al–10% Mg alloy was processed by the method of the present invention. The composition of the melt was as follows:

| Element | Percentage by weight |
|---|---|
| Si | 0.2 |
| Fe | 0.2 |
| Cu | 0.2 |
| Mn | 0.3 |
| Mg | 9.5 |

The alloy was cast to a strip thickness of 0.083 inch at 230 feet per minute speed. The strip was first cooled to about 650° F. by water sprays placed before the rolling mill. It was then immediately hot-rolled in-line in one step to a finish gauge of 0.035 inch followed by an anneal at 860° F. for 1 second for recrystallization and spray quenching to 190° F. The sheet was then coiled. Performance of the sheet in O-temper was evaluated by uniaxial tensile tests on ASTM—4 d samples removed from the last wraps of the coil. In the longitudinal direction, the samples showed TYS and UTS values of 32.4 and 58.7 ksi, respectively. These very high strength levels, higher by about 30% than those reported for similar alloys, were accompanied by high elongation: 32.5% total elongation and 26.6% uniform elongation. The samples showed very fine grain structure of ·10 μm size.

Example 4

In-line fabrication of a recyclable auto sheet alloy. An Al–1.4% Mg alloy was processed by the method of the present invention. The composition of the melt was as follows:

| Element | Percentage by weight |
|---|---|
| Si | 0.2 |
| Fe | 0.2 |
| Mn | 0.2 |
| Mg | 1.4 |

The alloy was cast to a strip thickness of 0.086 inch at 240 feet per minute speed. It was rolled to 0.04 inch gauge in one step, flash annealed at 950 F, following which it was water quenched and coiled. The quenching of the rolled sheet was done in two different ways to obtain O temper and T temper by different settings of the post quench 63. For the T temper, the strip was pre-quenched by quench 53 to about 700 F before warm-rolling to gauge and was post-quenched to 170 F. In a second case, the sheet was post quenched to around 700 F and was warm coiled to create O temper. The O-temper coil was done both by warm rolling and by hot rolling.

Performance of the sheet was evaluated by uniaxial tensile tests on ASTM—4 d samples and by hydraulic bulge test. In the T temper, the sheet showed tensile yield strength, ultimate tensile strength and elongation values well above the requirements for alloy 5754 in O-temper and as good as those available in sheet made by the conventional ingot method. In the hydraulic bulge test, too, the performance of the T temper AX-07 was very close to that of alloy 5754. This suggests that AX-07 in T temper made by the method of the present invention can be used to replace the 5754 sheet in inner body parts and reinforcements in auto applications. Such a replacement would have the advantage of making those parts recyclable into the 6xxx series alloys, by virtue of the lower Mg content, used in outer skin parts of autos without the need for separation.

Samples were also tested in O-temper made by the present method. In that temper, the strength levels were lower, around 8.8 ksi yield strength and 23 ksi tensile strength. The performance in the hydraulic bulge test improved equaling that of conventional 5754 . This temper thus offers a material that would be formed more easily at lower press loads.

Whereas particular embodiments of this invention have been described above for purposes of illustration, it will be evident to those skilled in the art that numerous variations of the details of the present invention may be made without departing from the invention as defined in the appending claims.

What is claimed is:

1. A method of manufacturing an O temper aluminum alloy sheet in a continuous in-line sequence comprising the steps of:

(i) providing a continuously-cast aluminum alloy strip as feedstock;

(ii) quenching the feedstock with a quenching device to a temperature for feeding into a hot or warm rolling mill;

(iii) hot or warm rolling the feedstock; and (iv) annealing the feedstock in-line to produce the O temper aluminum alloy.

2. The method of claim 1, further comprising tension leveling and coiling of the aluminum alloy sheet without requiring cold rolling prior to the leveling and the coiling of the aluminum alloy sheet.

3. The method to claim 1, wherein the continuous cast aluminum alloy strip has a thickness of about 0.06–0.25 inches.

4. The method of claim 1, wherein the hot or warm rolling step (iii) is carried out at a temperature of about 400° F. to 1020° F.

5. The method of claim 1, wherein the feedstock has a temperature of about 300° F. to 850° F. upon exit from the rolling in Step (iii).

6. The method of claim 1, wherein the quenching device is selected from the group consisting of a water spray device, an air jet device, or a combination thereof.

7. The method of claim 1, wherein the feedstock exists the quenching device at a temperature of about 400° F. to 900° F.

8. The method to claim 1, wherein the thickness of the feedstock after the hot/warm rolling of Step (iii) is about 0.02–0.15 inches.

9. The method of claim 1, wherein at Step (iv) the feedstock is annealed in-line at a temperature of about 700° F. to 950° F.

10. The method of claim 9, wherein the annealing is carried out for a period of about 0.1 to 10 seconds.

11. The method of claim 9, further comprising quenching the feedstock after Step (iv) to a temperature of about 110° F. to 720° F.

12. The method of claim 9, wherein the aluminum sheet has a thickness of about 0.02–0.15 inches.

13. The method of claim 1, wherein said aluminum alloy is selected from the group consisting of 1XXX, 2XXX, 3XXX, 5XXX, 6XXX, 7XXX, and 8XXX series alloys.

14. The method of claim 13, further comprising the step of moving the continuously east aluminum alloy strip through a trim station prior to quenching.

15. The method of claim 1, further comprising one or more rolling steps in addition of the rolling at Step (iii), prior to annealing in Step (iv).

16. The method of claim 15, further comprising one or more additional quenching steps between said rolling steps.

17. The method of claim 15, further comprising one or more heating steps between said additional rolling steps.

18. The method of claim 1, wherein the quenching of the feedstock in Step (ii) is to a temperature below 750° F.

19. A method of manufacturing a T temper aluminum alloy sheet in a continuous in-line sequence comprising the steps of:

(i) providing a continuously-cast aluminum alloy strip as feedstock;

(ii) quenching the feedstock with a quenching device to a temperature for feeding into a hot or warm rolling mill;

(iii) hot or warm rolling the feedstock; and (iv) solution heat treating the feedstock in-line to produce the T temper aluminum alloy.

20. The method of claim 19 further comprising tension leveling and coiling of the aluminum alloy strip.

21. The method to claim 19, wherein the continuous cast aluminum alloy strip has a thickness of about 0.06–0.25 inches.

22. The method of claim 19, wherein the hot or warm rolling step (iii) is carried out at a temperature of about 400° F. to 1020° F.

23. The method of claim 19, wherein the feedstock has a temperature of about 300° F. to 850° F. upon exit from the rolling in Step (iii).

24. The method of claim 19, wherein the quenching device is selected from the group consisting of a water spray device, an air jet device, or a combination thereof.

25. The method of claim 19, wherein the feedstock exists the quenching device at a temperature of about 400° F. to 900° F.

26. The method to claim 19, wherein the Thickness of the feedstock after the hot/warm rolling of Step (iii) is about 0.02–0.15 inches.

27. The method of claim 19, wherein at Step (iv) the feedstock is solution heat treated at a temperature of about 980° F. to 1000° F.

28. The method of claim 19, wherein the solution heat treatment is carried out for a period of about 0.1 to 10 seconds.

29. The method of claim 19, further comprising quenching the feedstock after Step (iv) to a temperature of about 110° F. to 350° F.

30. The method of claim 19, further comprising one or more rolling steps in addition to the rolling at Step (iii), prior to solution heat treatment in Step (iv).

31. The method of claim 30, further comprising one or more additional quenching steps between said rolling steps.

32. The method of claim 30, further comprising one or more heating steps between said additional rolling steps.

33. The method of claim 19, wherein the quenching of the feedstock in Step (ii) is to a temperature below about 750° F.

34. A method of manufacturing an O temper aluminum alloy sheet without cold rolling in an in-line sequence comprising the steps of;

(i) providing a thin east aluminum alloy strip having a first thickness;

(ii) quenching the strip with a quenching device;

(iii) hot or warm rolling the strip in line to a final thickness, the rolling step (iv) retaining alloying elements substantially in solution;

(v) annealing the strip, and (vi) quenching the strip to a temperature of about 110° F. to 720° F. to form an O temper.

35. The method of claim 34, further comprising tension leveling and coiling of the aluminum alloy sheet.

36. The method of claim 34, wherein the hot or warm rolling step (iii) is carried out at a temperature of about 400° F. to 1020° F.

37. The method of claim 19, wherein the feedstock has a temperature of about 300° F. to 850° F. upon exit from the rolling in Step (iii).

38. The method of claim 37, wherein the annealing is carried out for a period of about 0.1 to 10 seconds.

39. The method of claim 34, wherein the quenching is performed with a quenching device.

40. A method of manufacturing T temper aluminum alloy sheet without cold rolling in an in-line sequence comprising the steps of:

(i) providing a thin cast aluminum alloy strip having a first thickness;

(ii) quenching the strip with a quenching device:

(iii) hot or warm rolling the strip in line to a final thickness, the rolling retaining alloying elements substantially in solution;

(iv) solution heat treating the aluminum alloy strip, and (v) quenching the strip to a temperature of about 110–350° F. to form a T temper.

41. The method of claim 40, further comprising tension leveling and coiling of the aluminum alloy sheet.

42. The method of claim 40, wherein the hot or warm rolling in Step (iii) is carried out at a temperature of about 400° F. to 1020° F.

43. The method of claim 40, wherein at Step iv the feedstock is solution heat treated at a temperature of about 800° F. to 1020° F.

44. The method of claim 43, wherein the solution heat treatment is carried out for a period of about 0.1 to 10 seconds.

45. The method of claim 40, wherein said aluminum alloy is selected from the group consisting of 2XXX, 6XXX, and 7XXX Series alloys.

* * * * *

UNITED STATES PATENT AND TRADEMARK OFFICE

CERTIFICATE OF CORRECTION

PATENT NO. : 7,182,825 B2
APPLICATION NO. : 10/782027
DATED : February 27, 2007
INVENTOR(S) : Ünal et al.

It is certified that error appears in the above-identified patent and that said Letters Patent is hereby corrected as shown below:

Column 9, line 52, delete "(6b)" and insert --(FIG. 6b)--.

Signed and Sealed this

Thirty-first Day of July, 2007

JON W. DUDAS
*Director of the United States Patent and Trademark Office*